US005960693A

United States Patent [19]

Yuda, Jr.

[11] Patent Number: 5,960,693

[45] Date of Patent: Oct. 5, 1999

[54] CONTROL APPARATUS FOR PNEUMATICALLY OPERATED EXTENSIBLE MEMBER AND METHOD

[75] Inventor: Lawrence F. Yuda, Jr., West Union, S.C.

[73] Assignee: Compact Air Products, Inc., Westminster, S.C.

[21] Appl. No.: 08/610,269

[22] Filed: Mar. 4, 1996

Related U.S. Application Data

[63] Continuation of application No. 08/312,057, Sep. 26, 1994, abandoned.

[51] Int. Cl.[6] ..... F01B 13/00

[52] U.S. Cl. ..... 91/61; 92/31; 92/136; 60/407

[58] Field of Search ..... 92/145, 136, 31, 92/165 PR, DIG. 3; 91/362, 55, 61; 60/399, 400, 403, 407, 327; 417/415

[56] References Cited

U.S. PATENT DOCUMENTS

| | | | |
|---|---|---|---|
| 1,549,332 | 8/1925 | Roberts | 92/136 X |
| 5,284,423 | 2/1994 | Holdsworth et al. | 417/415 X |
| 5,577,433 | 11/1996 | Henry | 92/136 X |

*Primary Examiner*—Hoang Nguyen
*Attorney, Agent, or Firm*—Ralph Bailey, P.A.

[57] ABSTRACT

Control apparatus and method for applying power to a linear actuator (A) utilizes an air cylinder (B) and a self-locking drive (C) rotated by an electric motor (D) for affording positioning and velocity control for the air operated cylinder and the guided linear actuator which stops and is positively positioned upon cessation of rotation of the drive by the electric motor.

5 Claims, 5 Drawing Sheets

CONTROL APPARATUS FOR PNEUMATICALLY OPERATED EXTENSIBLE MEMBER AND METHOD

This application is a continuation of application Ser. No. 08/312,057, filed Sep. 26, 1994, now abandoned.

BACKGROUND OF THE INVENTION

This invention relates to a combination air cylinder and electric motor drives for applying power through a linear actuator.

The characteristics of a pneumatic cylinder include a capability for producing great forces through the use of a readily available source of power utilizing simple inexpensive constructions. Pneumatic cylinders have a notable disadvantage in that, once in motion, it is very difficult to stop the piston rod or other operating mechanism in a precisely desired position. Electric cylinders or linear actuated devices powered by an electric motor as may be operated through the use of a screw threaded drive are relatively simple in design offering precise positioning in fast or slow motion so as to offer both position and velocity control. Such systems utilize a clean readily available power source with little or no noise or leakage problems. Since the electrically driven actuators utilize a common source of power they may indirectly interface with controllers, computers and the like. Very small power to weight ratios, however, make them efficient from the standpoint of space considerations. Moreover, loads may back drive the cylinder.

Servo controlled air cylinders provide power to weight ratios conducive to space efficiency. A feed back system may be provided for positioning each cylinder and integrated with a system of valves and feedback devices operating through a dedicated controller. Such cylinders may be infinitely positionable or positioned in discreet stroke increments. Closed loop hydraulic systems offer comparable results to electric cylinders but such cannot be utilized in pneumatic systems due to compressibility of the media. Suitable velocity control characteristics are not provided by such complicated systems.

Accordingly, it is desired to obtain positive positioning and velocity control in an air operated cylinder by a simplified operating mechanism.

SUMMARY OF THE INVENTION

Accordingly, it is an important object of this invention to provide an air cylinder affording substantial power and yet having the controllability of an electric cylinder from the standpoint of speed and positioning.

It is an important object of the invention to obtain both position and velocity control in a space efficient package.

Another important object of the invention is to provide an air operated cylinder utilizing a stepper motor controller so as to eliminate the need for feedback devices.

Another important object of the invention is to provide a stepper motor for controlling an air cylinder so that the stepper motor can be directly interfaced with controllers and computers.

Another important object of the invention is to utilize an electric motor for operating an air cylinder wherein the electric motor would be reduced in size on the order of about 1/10 that which would be required in a comparable electric cylinder.

Another important object of the invention is to provide an air cylinder controlled by an electric motor such that the friction inherent in a screw thread drive is utilized advantageously to provide self-locking so that the load cannot back drive the cylinder in case of power loss.

Still another important object of the invention is the provision of an electric control operating mechanism for an air cylinder for providing both position and velocity control and yet making it possible to match the force provided by the cylinder to the load without dependence upon an electric drive for actually moving the load.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
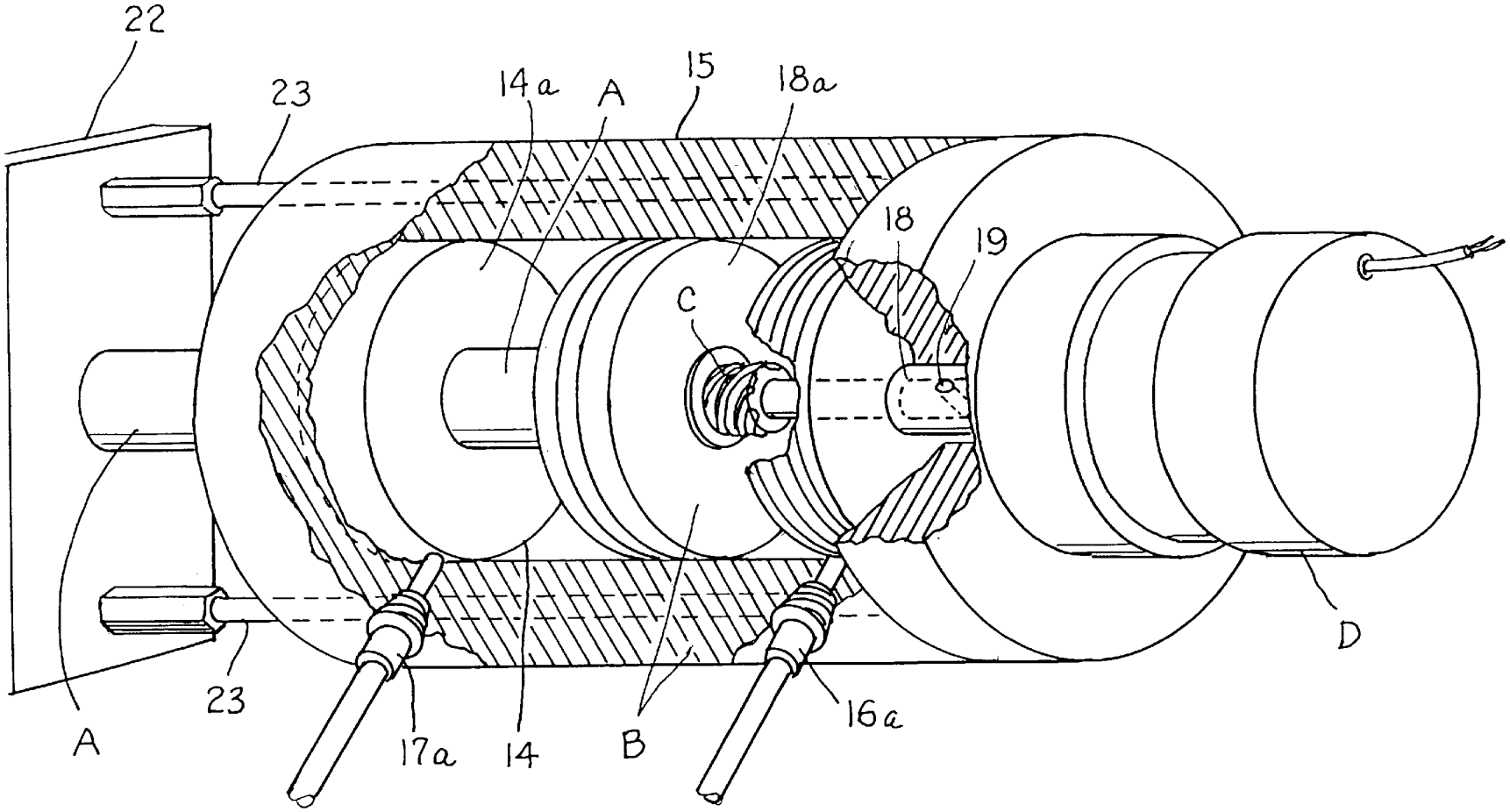
FIG. 1 is a perspective view illustrating an electric motor control for operating a pneumatic cylinder constructed in accordance with the invention.
Figure 2:
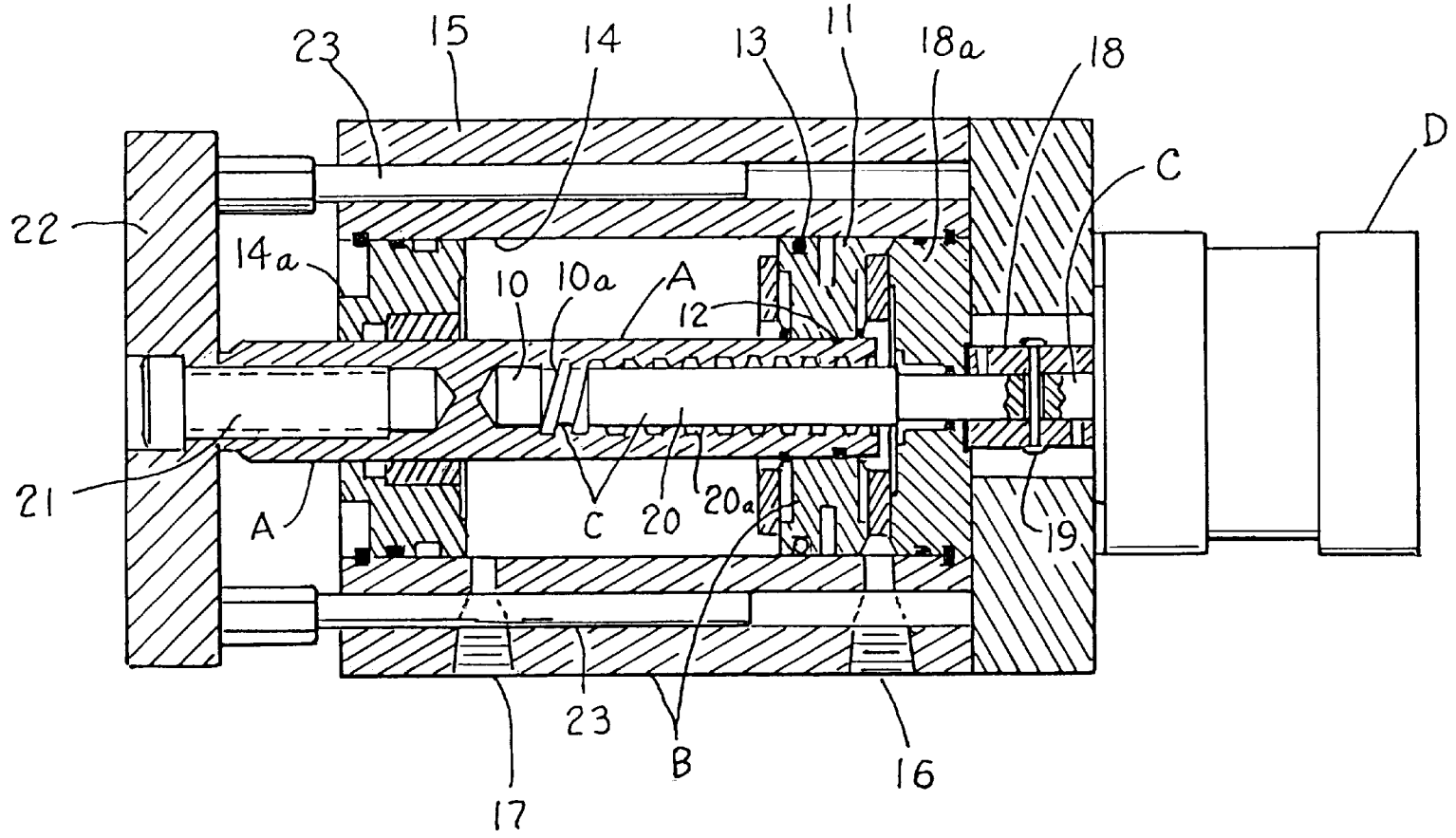
FIG. 2 is a longitudinal sectional elevation of the apparatus illustrated in FIG. 1 wherein the length of the threading of the electrically driven operator is relatively short compared to the length of the internal threading of the piston rod.
Figure 3:
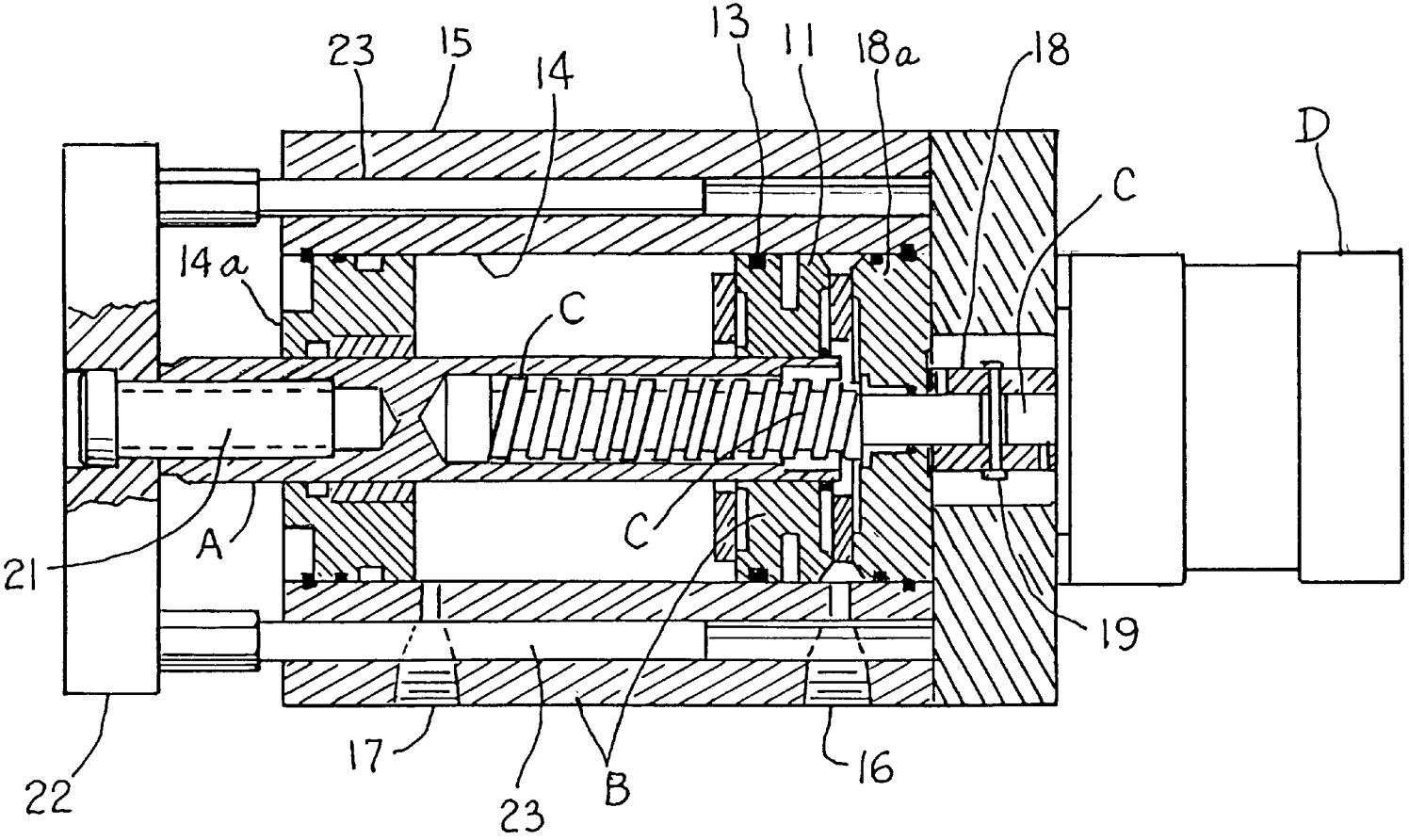
FIG. 3 is a longitudinal sectional elevation similar to FIG. 2 but illustrating a modified form of the invention wherein the internal threading of the piston rod is relatively short as compared to that of the motor driven operator.

The drawings illustrate a power operated linear actuated mechanism including an elongated extensible member A such as the piston rod. Air operated apparatus B is provided for urging the extensible member in a direction to exert a power stroke. A source of air under pressure actuates the air operated apparatus. A threaded drive C is carried for rotation in a direction permitting travel of the extensible member in said direction. An electric motor D actuates the threaded drive for rotation. Thus the air operated apparatus and the electric motor may operate to forcefully move the extensible member in said direction, and the electric motor and threaded drive provide positive positioning for the extensible member. The elongated extensible member A is illustrated as including a piston rod. The air operated apparatus B includes a cylinder, a piston carried in the cylinder, and an air inlet port connected to the source of air. The threaded drive C includes an internally threaded portion of the elongated extensible member, and an elongated externally threaded member, driven by the electric motor D, in threaded engagement within the internally threaded portion.

The elongated extensible member A is illustrated as including a piston rod which has a bore 10 therein with internal threads boa. The piston rod has connection on one end with a piston 11 which is fastened by means of a ring 12 to the piston rod. Suitable seals including the O-ring 13 are provided for the piston within the internal cylindrical walls 14 within the cylinder housing 15. The piston 11 and the cylinder 15 and associated parts form an air operated apparatus which further includes an inlet port 16 having a fitting 16*a* which is utilized to extend the piston rod as well as an inlet port 17 having a fitting 17*a* which is used to retract the piston rod.

The threaded drive C includes a flexible power takeoff shaft 18 connected to the flexible coupling 19. The power takeoff shaft 18 is thus connected to a threaded shaft 20 which forms a part of the threaded drive C. The shaft 20 has external threads 20*a* in threadable engagement with the internal threads 10*a* within the bore 10 within the piston rod A. It will be observed that the power takeoff shaft extends through an internal rear end cap 18*a* in suitable sealed relation and that the piston rod A extends through a head end cap 14*a* in proper sealed relation thereto.

It will be observed that the piston rod A is connected by a threaded fastener 21 to a yoke 22. As illustrated in U.S. Pat. No. 5,113,746 the yoke has suitable connection to a pair of guide rods 23 for insuring the maintenance of accurate alignment of the piston rod. The disclosure of the patent is incorporated herein by reference.

Figure 4:
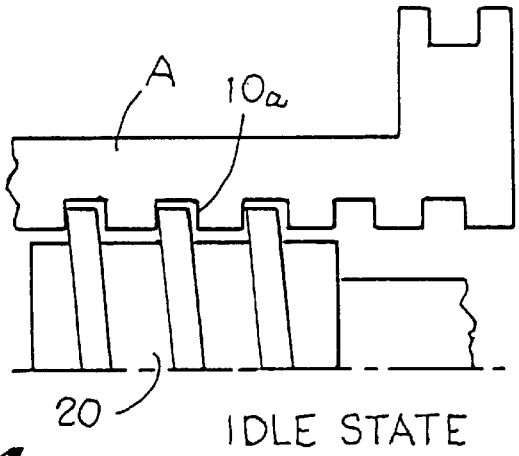
FIG. 4 is an enlarged sectional elevation illustrating the thread interface between the threaded drive members during an idle state.
Figure 5:
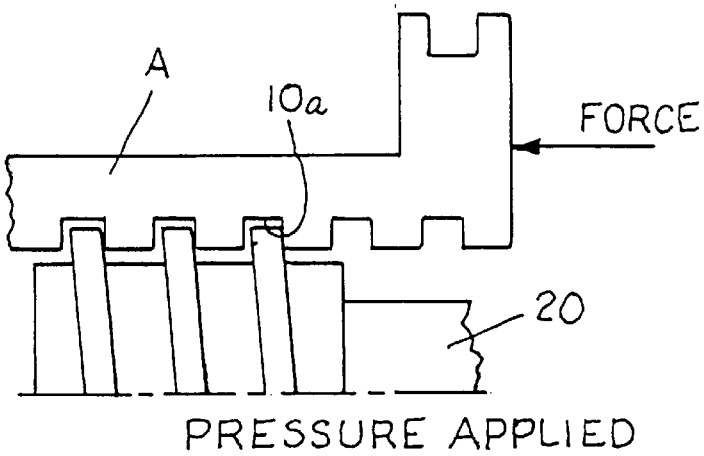
FIG. 5 is an enlarged longitudinal sectional elevation illustrating the interrelation of the threads of the electrically driven members when hydraulic pressure is applied.
Figure 6:
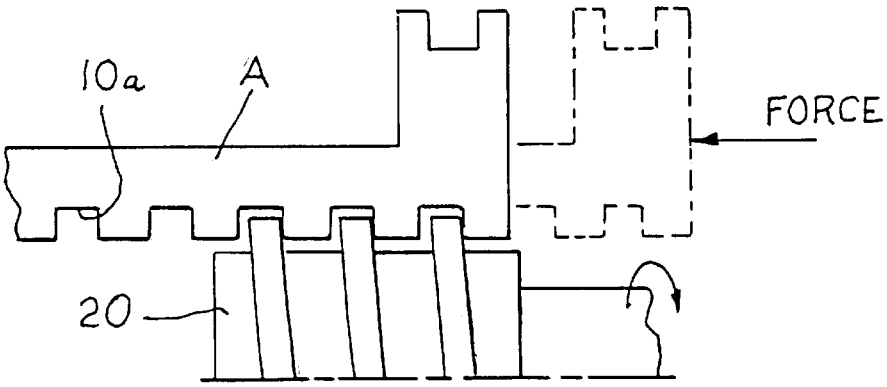
FIG. 6 is an enlarged longitudinal sectional elevation similarly to FIG. 5 illustrating the relationship of the parts of the threaded drive during the application of pneumatic force and rotational force applied by the electric motor.

FIGS. 4–6 illustrate the relationship of the respective parts of the threaded drive during a sequence of operation wherein in the idling state there is only incidental engagement between the externally threaded drive shaft 20 and the internal threads 10*a* of the piston rod. In FIG. 5 the application of pneumatic forces causes the back portions of the respective threads to become engaged whereas in FIG. 6 rotation may be readily applied because such tends to move the piston rod in the same direction as that caused by the application of the pneumatic force. A cessation of the application of rotational force by the electric motor brings about a cessation of movement of the piston rod A.

Figure 7:
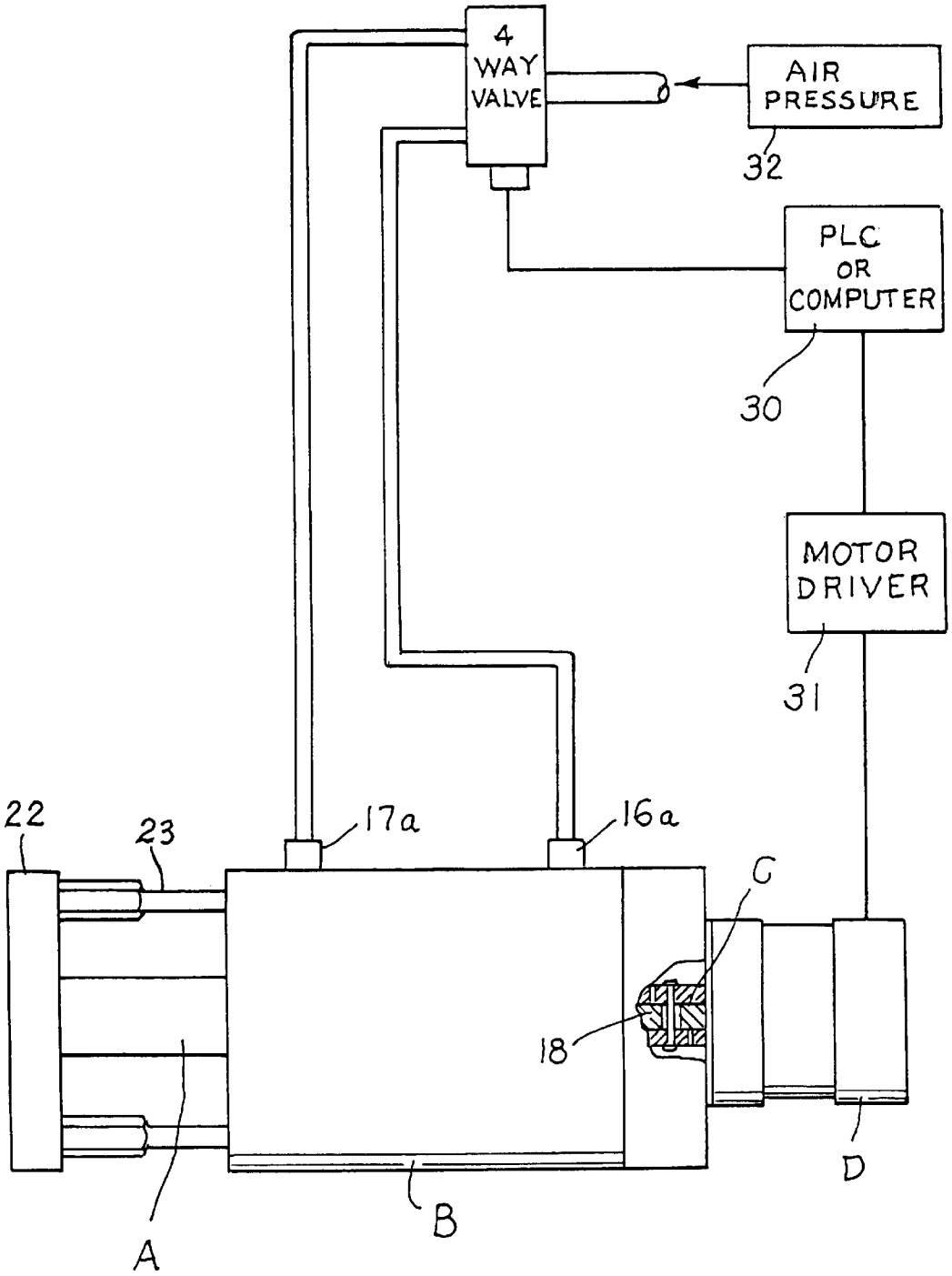
FIG. 7 is a block diagram illustrating the pneumatic and electrical components of the apparatus.

Referring more particularly to FIG. 7, it will be noted that a suitable stepper motor D may be utilized as illustrated. A programmable, logic controller or computer 30 may be utilized to operate a suitable motor driver 31 for controlling the stepper motor D. A source of air pressure 32 delivers air through a suitable 4-way valve to the connections 16*a* and 17*a* for operating the air operated cylinder B.

It is thus seen that positive positioning and velocity control is achieved for an air operated cylinder. The piston rod provides pneumatic force which is subject to positive positioning and velocity control by the electric motor. The piston rod which operates as a linear actuator may operate any desired mechanism through suitable auxiliary drives.

While a preferred embodiment of the invention has been described using specific terms, such description is for illustrative purposes only, and it is to be understood that changes and variations may be made without departing from the spirit or scope of the following claims.

What is claimed is:

1. The method of positioning an external load moved by a pneumatic linear actuator having an air operated cylinder and piston powering an extensible member for moving the external load comprising the steps of:

applying sufficient force by supplying air under pressure to the cylinder and piston to match the external load for movement responsive thereto;

utilizing threadable frictional engagement between threads carried by the piston and threads carried by a lead screw which is alone sufficient to prevent movement of the load responsive to supplying air under pressure in the absence of an external torque rotating the lead screw;

controlling the output of an electric motor to provide sufficient external torque to overcome the frictional engagement thereby rotating the lead screw permitting the force applied by the air under pressure to move the external load; and discontinuing the application of the external torque by the electric motor when the desired movement of the external load has been accomplished by the force applied by the air under pressure thereby returning the lead screw to frictional engagement in respect to the piston to discontinue movement of the load responsive to the force applied by air under pressure;

whereby a heavy load can be moved and then positioned in a predetermined location by exerting sufficient external torque to overcome the frictional engagement thereby imparting rotation to the lead screw during movement of the load and then discontinuing the application of external torque by the electric motor.

2. The method set forth in claim 1 including the step of providing threads substantially entirely along the lead screw.

3. The method set forth in claim 1 including the step of controlling the electric motor and the supplying of air under pressure directly responsive to computer operated controller means.

4. The method set forth in claim 1 including the step of positioning an internally threaded piston rod in axial alignment for receiving the lead screw and for transmitting force to the external load.

5. The method set forth in claim 1 including the step of positioning the electric motor in axial alignment with the lead screw remote from the external load.

* * * * *

UNITED STATES PATENT AND TRADEMARK OFFICE

CERTIFICATE OF CORRECTION

PATENT NO. : 5,960,693

DATED : October 5, 1999

INVENTOR(S) : Lawrence F. Yuda, Jr.

It is certified that error appears in the above-identified patent and that said Letters Patent is hereby corrected as shown below:

On the Title Page:

Item [75] Lawrence F. Yuka, Jr. and Prasad Balakrishnan

Signed and Sealed this

Tenth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,960,693
DATED : October 5, 1999
INVENTOR(S) : Lawrence F. Yuda, Jr.

It is certified that error appears in the above-identified patent and that said Letters Patent is hereby corrected as shown below:

Title page,
Item [75], Lawrence F. Yuda, Jr. and Prasad Balakrishnan

This certificate supercedes certificate of correction issued April 10, 2001.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*